US006123649A

United States Patent [19]

Lee et al.

[11] Patent Number: 6,123,649

[45] Date of Patent: Sep. 26, 2000

[54] RESISTANCE APPARATUS FOR CONNECTION TO A HUMAN BODY

[76] Inventors: R. Clayton Lee, 10369 Briar Forest, Houston, Tex. 77042; Michael A. Karr, Jr., 9353 Rosstown, Houston, Tex. 77080

[21] Appl. No.: 09/320,599

[22] Filed: May 26, 1999

Related U.S. Application Data

[63] Continuation-in-part of application No. 09/023,548, Feb. 13, 1998, abandoned.

[51] Int. Cl.[7] ..... A63B 22/00

[52] U.S. Cl. ..... 482/54; 482/51

[58] Field of Search ..... 482/51, 54, 14, 482/39, 66, 121, 124, 145

[56] References Cited

U.S. PATENT DOCUMENTS

| | | | |
|---|---|---|---|
| 1,016,729 | 2/1912 | Barrett | 482/54 |
| 2,017,128 | 10/1935 | O'Neill | 482/54 |
| 3,596,907 | 8/1971 | Brighton et al. . | |
| 3,764,132 | 10/1973 | Hepburn . | |
| 4,114,874 | 9/1978 | Mattila . | |
| 4,114,875 | 9/1978 | Deluty . | |
| 5,147,264 | 9/1992 | Braathen . | |
| 5,226,867 | 7/1993 | Beal . | |
| 5,486,149 | 1/1996 | Smith et al. . | |
| 5,733,231 | 3/1998 | Corn et al. . | |

*Primary Examiner*—Glenn E. Richman
*Attorney, Agent, or Firm*—Harrison & Egbert

[57] ABSTRACT

A resistance apparatus for use in fitness exercising and rehabilitation having a treadmill with a rearward end, a frame connected to the treadmill and positioned behind the rearward end of the treadmill, and a resistance apparatus affixed to the frame and having an end connectable to a human body. The resistance apparatus exerts a resistance force onto the human body from a back of the human body so that the human body carries out a forward motion on the treadmill. The frame includes a horizontal section connected to the treadmill and a vertical section extending upwardly from the horizontal section. The resistance apparatus is connected to the vertical section. The resistance apparatus includes a cord extending from the frame and having a mechanism attached to an end thereof so as to allow the cord to be connected to a human body.

9 Claims, 11 Drawing Sheets

FIG. 1
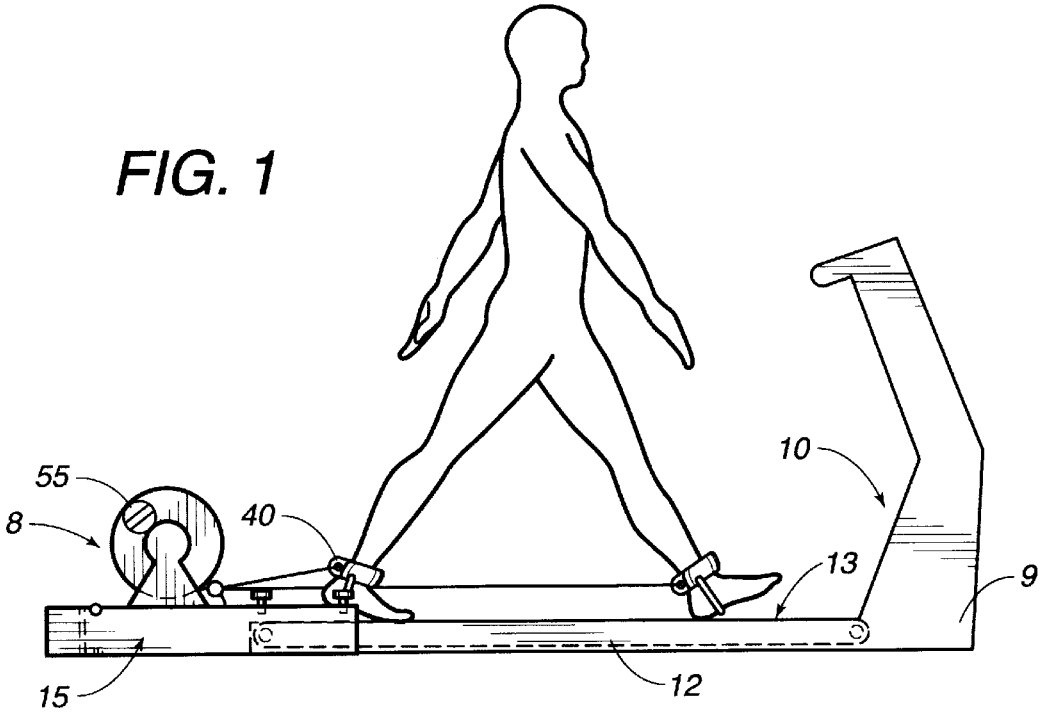
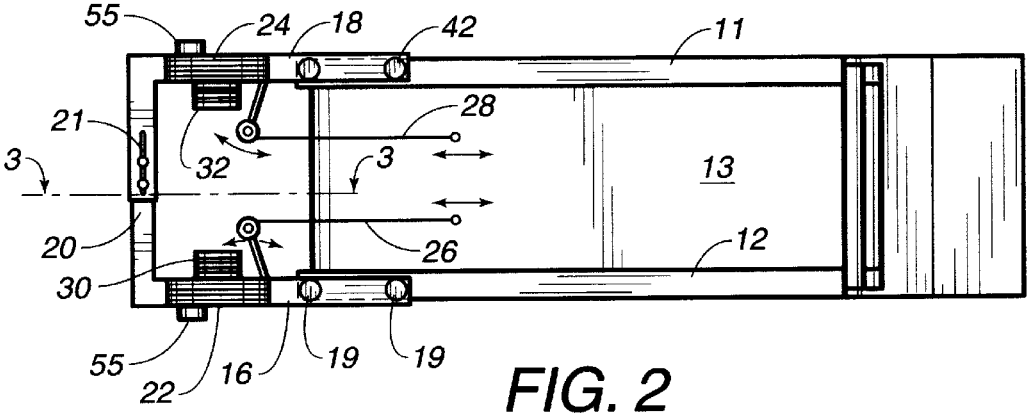
FIG. 2
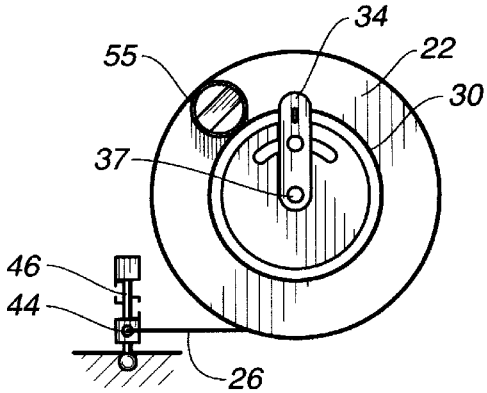
FIG. 3
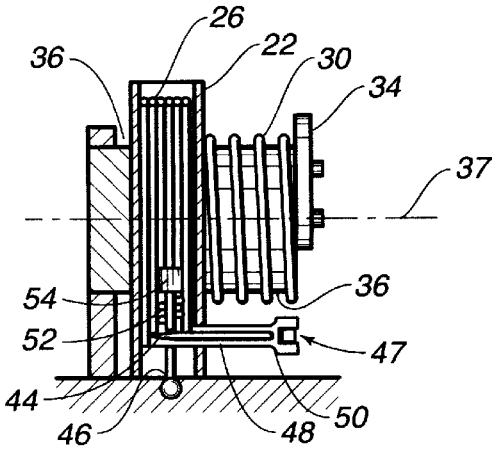
FIG. 4

FIG. 9
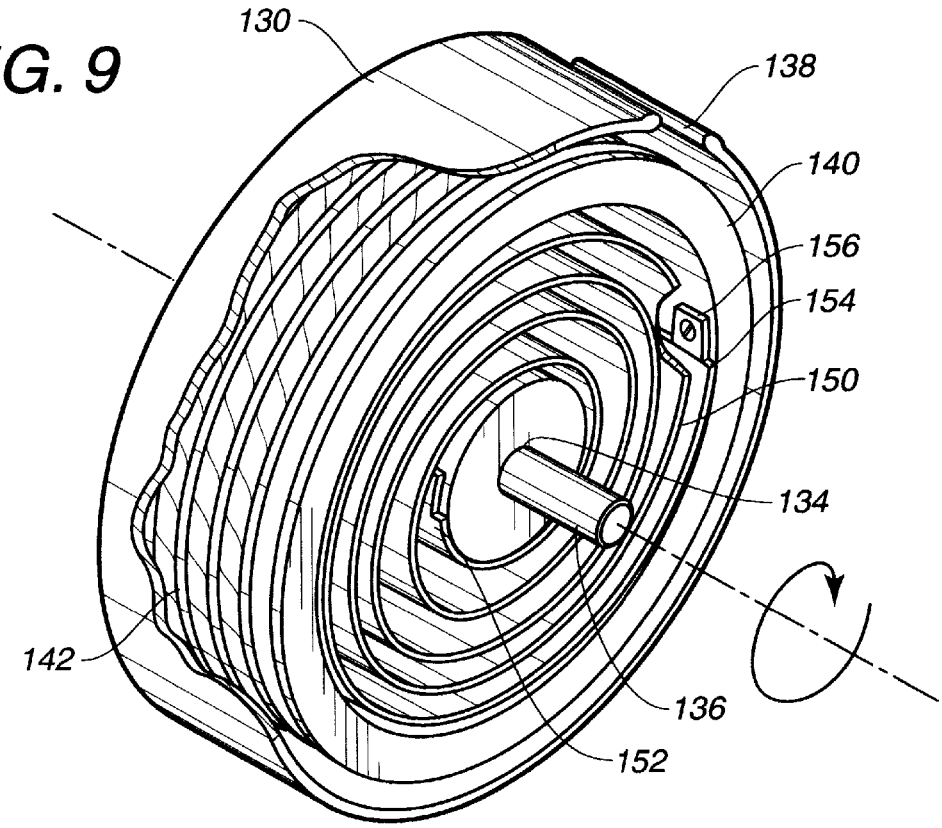
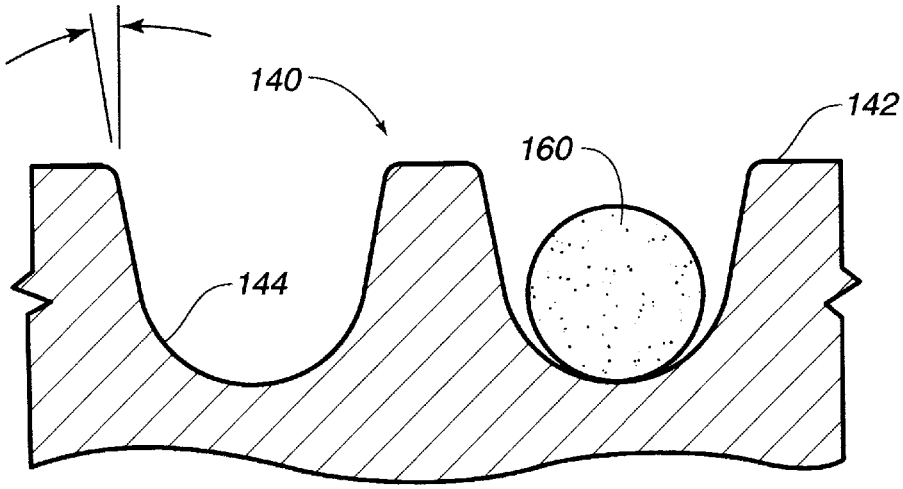
FIG. 10

RESISTANCE APPARATUS FOR CONNECTION TO A HUMAN BODY

RELATED APPLICATION

The present application is a continuation-in-part of U.S. patent application Ser. No. 09/023,548, filed on Feb. 13, 1998, abandoned, and entitled "RESISTANCE APPARATUS FOR HUMAN LIMBS," presently pending.

FIELD OF THE INVENTION

This invention relates to an exercise and rehabilitation apparatus and particularly to a resistance apparatus that can be used with or without a treadmill that includes a means for exercising a user's leg and/or arm and its connecting muscles with an independently adjustable restraining or resisting force for each individual leg and/or arm.

BACKGROUND OF THE INVENTION

Exercise equipment includes a multitude of devices for use with arm and leg members for the purpose of stimulating and developing muscle tone, strength and agility as well as for reducing weight and fat tissue.

It is recognized that walking is a natural form of exercise and that the use of a treadmill apparatus has definite beneficial values in walking, jogging and running exercises by providing a movable surface on a stationary platform unit. The speed and slope of the walking surface can be controlled to the needs and fitness level of the participant. While the treadmill has many advantages, fitness enthusiasts, physical therapists, trainers and others may desire to provide additional beneficial muscle exercises concurrently with the type of exercise provided by a treadmill.

A new form of exercise is a parachute training device. In this type of exercise, the user will use a small parachute. The person begins a running motion so as to open the parachute and to create a resistance to the forward movement. This rearward resistance force greatly enhances the speed training of the human body. Unfortunately, the use of such a parachute device requires a relatively large open area. These type of devices are not adapted nor suitable for indoor training. Additionally, although such devices are extremely effective in speed training and in muscle conditioning, the cords associated with the parachute can often become tangled with the legs of the user so as to cause the user to fall. Furthermore, if sufficient speed is not applied to the parachute, it will not open properly so as to create the necessary resistance force.

The present invention provides a system for adding and controlling exercise resistance force to the leg, thigh, calf and trunk muscles as well as certain other body muscle groups such as the arms. This resistance force is applied to each leg or arm in an independent manner. More specifically, the major leg muscles involved are the quadriceps, the upper thigh, anterior and posterior, hamstrings, buttocks and lower back. The major arm muscles involved are the deltoids, triceps, biceps, brachialis, flexors and the other interacting arm muscle groups. Additionally, muscle groups in the body which interact with the leg and arm muscles and other major muscle groups of the body can be exercised. This system can be connected to the trunk of the body so as to exercise the legs, abdomen and stomach muscles.

Another benefit of the present invention is that the force resistance is provided from the back of the body rather than from the front of the body. As such, the benefit of the present invention follows the common position of usual resistance forces. Furthermore, the resistance provided by the present invention allows for positive loading to the body during exercise in that the tension or resistance being applied to the body is constant. This differs from the prior art in which treadmills typically provide resistance from the front. As such, the exercise is carried out on conventional treadmills in an inefficient and ineffective way. Proper resistance from the back is most desirable.

SUMMARY OF THE INVENTION

The present invention is a resistance apparatus for use in fitness exercising and rehabilitation having a treadmill with a forward end and a rearward end, a frame connected to the treadmill and positioned behind the rearward end of the treadmill, and a resistance means affixed to the frame and having an end connectable to a human body. The resistance means exerts a resistance force onto the human body from a back of the human body as the human body carries out a forward motion on the treadmill. In particular, the resistance means includes a cord which can extend from the frame and includes a mechanism at the opposite end suitable attachment to either the legs, arms or trunk of a human body. The frame can be integrally connected to the treadmill or can be detachably connected to the treadmill, as the need would be.

In particular, the resistance means used by the present invention can be an elastomeric cord which is connected to a frame positioned behind the treadmill. The resistance means can also include stacks of weights which are pulley-supported or otherwise movable in relation to the motion of the human body on the treadmill. The resistance means can also include particle brakes, gas or air compression cylinders, low load coil springs, higher load coil springs attached to an elastomeric cord, a dual bow action attached to cords, or elastomeric members having cords extending therefrom.

Still further and alternatively, the resistance means can include a housing, a first pulley fixedly mounted within the housing, a second pulley resiliently connected in the housing, and a cable extending around the first and second pulley so as to have an end extending outwardly of the housing. The cable will have an opposite end suitable for connection to a human body. An adjustment mechanism is interconnected to the first and second pulleys so as to adjust a tension of the cable as extending from the second pulley. This adjustment mechanism includes a spring which is connected to the second pulley, a nut threadedly connected to the spring, and an adjustment screw threadedly received by the nut. The adjustment screw has a head portion extending outwardly of the housing. The head portion is adapted for manual adjustment exterior of the housing.

BRIEF DESCRIPTION OF THE DRAWINGS

FIG. 1 is a side plan view of one embodiment of the present invention in use with a treadmill;

FIG. 2 is a top plan view of the present invention of FIG. 1;

FIG. 3 is a side plan view taken along line 3—3 of FIG. 2;

FIG. 4 is partial, cross sectional front plan view of FIG. 3;

FIG. 9 is a partial cut-away perspective view of the apparatus of FIG. 8;

FIG. 10 is an exploded cross sectional view of a detail of the apparatus of FIG. 8;

DETAILED DESCRIPTION OF INVENTION

Figure 17:
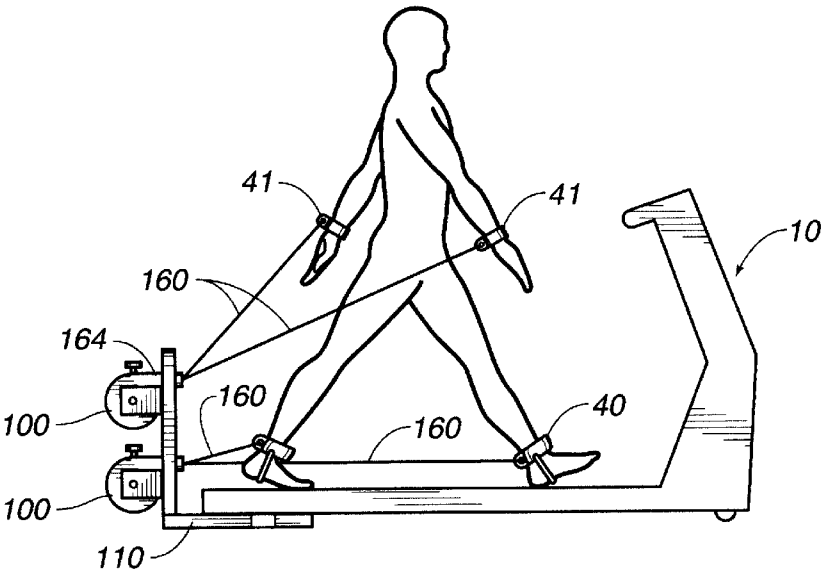
FIG. 17 is a side plan view of an alternate configuration of the invention of FIG. 5.
Figure 19:
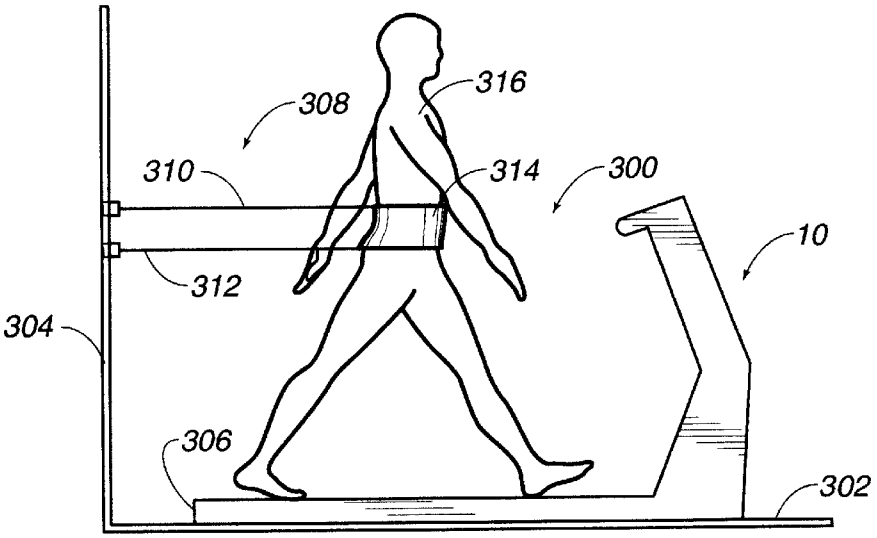
FIG. 19 is a side plan view of a another simplified form of the present invention and shown as attached to the trunk of a human body.
Figure 18:
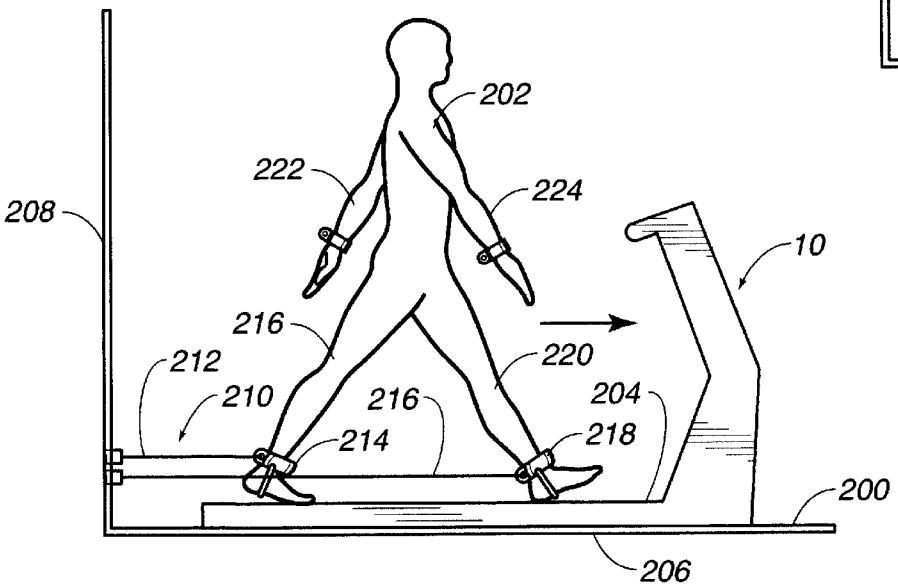
FIG. 18 is a side view of a simplified form of the present invention and shown as attached to the legs of a human body.

The present invention is a resistance apparatus for use in fitness exercise and rehabilitation. The apparatus includes a treadmill having a forward end and a rearward end, a frame connected to the treadmill and positioned behind the rearward end of the treadmill, and a resistance means affixed to the frame and an end connectable to a human body. The resistance means serves to exert a resistance force onto the human body from the back of the human body as the human body carries out a forward motion on the treadmill. The simplest form of the present invention is illustrated in FIGS. 18 and 19. However, within the scope of the present invention, various other configurations of the present invention can be adopted, as illustrated in FIGS. 1–17. In particular, it should be noted that the resistance means can include a spring mechanism (as illustrated in FIGS. 1–17), elastomeric cords, weight stacks, particle brakes, gas or air compression cylinders, low load or higher load coil springs connected individually to the user or to cords extending to the body of the user, a dual bow action attached to the human body directly or thorough the use of elastomeric cords, or to elastomeric members having cords extending therefrom. Still further, and alternatively, the "resistance means" can also include a pulley/spring mechanism (as illustrated with particularity in FIGS. 20–22). The frame can either be integrally formed with the treadmill (as shown in FIGS. 18, 19, 21 and 22) or can be detachably connected to the frame of the treadmill (as illustrated in FIGS. 1–17).

A treadmill 10 is illustrated in FIG. 1 with a body frame 9 which includes parallel floor side rails 11, 12, and an endless movable belt 13 which can be mounted on transverse rollers in the body frame 9. The belt can be manual or motor driven, as desired. The resistance apparatus 8 of the present invention includes a frame member 15 with parallel sides 16 and 18 which are releasably attachable to the side rails 11 and 12 of the treadmill 10 by bolts 19, clamps or other means. The side rails 16 and 18 can be L-shaped with overlapping central ends 20 and 21 which provide a width adjustment to accommodate various widths of treadmills. Attached to each side rail 16 and 18 is a pair of spools 22 and 24 of wire or line in which the spools 22, 24 are respectively rotatable on a journal or supporting member 36 about an axis 37. Each spool 22, 24 is connected to one end of an adjustable spiral, or clock spring 30 or 32 located in the journal 36. Each spring 30, 32 has its other end independently connected to an adjustable arm 34 on the journal 36. For example, as shown in FIG. 3 and FIG. 4, the spring 30 has one end attached to the spool 22 and the other end attached to the arm 34. The arm 34 is pivotally adjustable about the horizontal axis 37 and can be moved rotatively through an arc about the axis 37 and can be fixed at any location along the arc of travel. The location of the arm 34 adjusts the relaxed location of an ankle cuff 40 (the length of the line 26) relative to the ends 42 of the frame member 16, 18.

A normal foot location on the treadmill belt 13 is a location of a foot arch in alignment with the ends 42. With this arrangement, when both ankle cuffs 40 are attached to the ankles of an individual and the arches of the feet are located on the alignment line with the ends 42, the degree of initial tension on the ankles is set by the length of lines 26 or 28. The length of line 26 or 28 is set by the position of the spring 30 and the arm member 34. When a step is taken, the spring 30 is tensioned and requires muscle exertion to move to the forward step position as shown in FIG. 1. At the end of a step, the individual again must exert muscles to counteract the return torsion/tension force of the spring 30.

It can be appreciated that the tensioning of the springs 30, 32 is a fairly uniform function of the spring forces and that each leg or arm is independently controlled. Additional control of the torsion/tension force of the springs 30, 32 in either a forward or rearward step motion, is effected by independently adjustable brakes 55 applied to the spools 22, 24. By adjusting the braking force on the spools 22, 24, the range of torsion/tension control of the springs is increased.

As shown in the drawings, the line or wire 26 or 28 passes from the spools 22 or 24 to a first transverse pulley and gimbal 44 located on a vertical post 46. The line passes through a slot 48 in an elongated and transverse tension arm 50 to a second pulley and gimbal 47 at the end of the arm 50 and thence to an ankle cuff 40. One end of the arm 50 is rotatably mounted on the post 46 between arcuate limit positions, and an adjustable spring 52 is connected between the arm 50 and an adjustable knob 54. By virtue of the adjustment knob 54, the spring 52 can locate the arm 50 against the rearward limit position so that additional spring torsion/tension can be required initially to move the line 26, 28 with a step. By controlling the degree of torsion/tension required to move the tension arm 50 between the limit positions, additional torsion/tension can be required by a leg motion in the initial step and when the foot is lifted. Because the tension arm 50 has a limited arc movement by virtue of limit stops between the post 46 and the arm 50, the torsion/tension is selective to the initial motion until a limit stop is reached where the torsion/tension is applied to the spring 30. Thus, the resistance is principally applied at the forward and rearward step motions. However, with the combination of spring force, a variable and infinite range (between limits) of resistance is provided.

Figure 5:
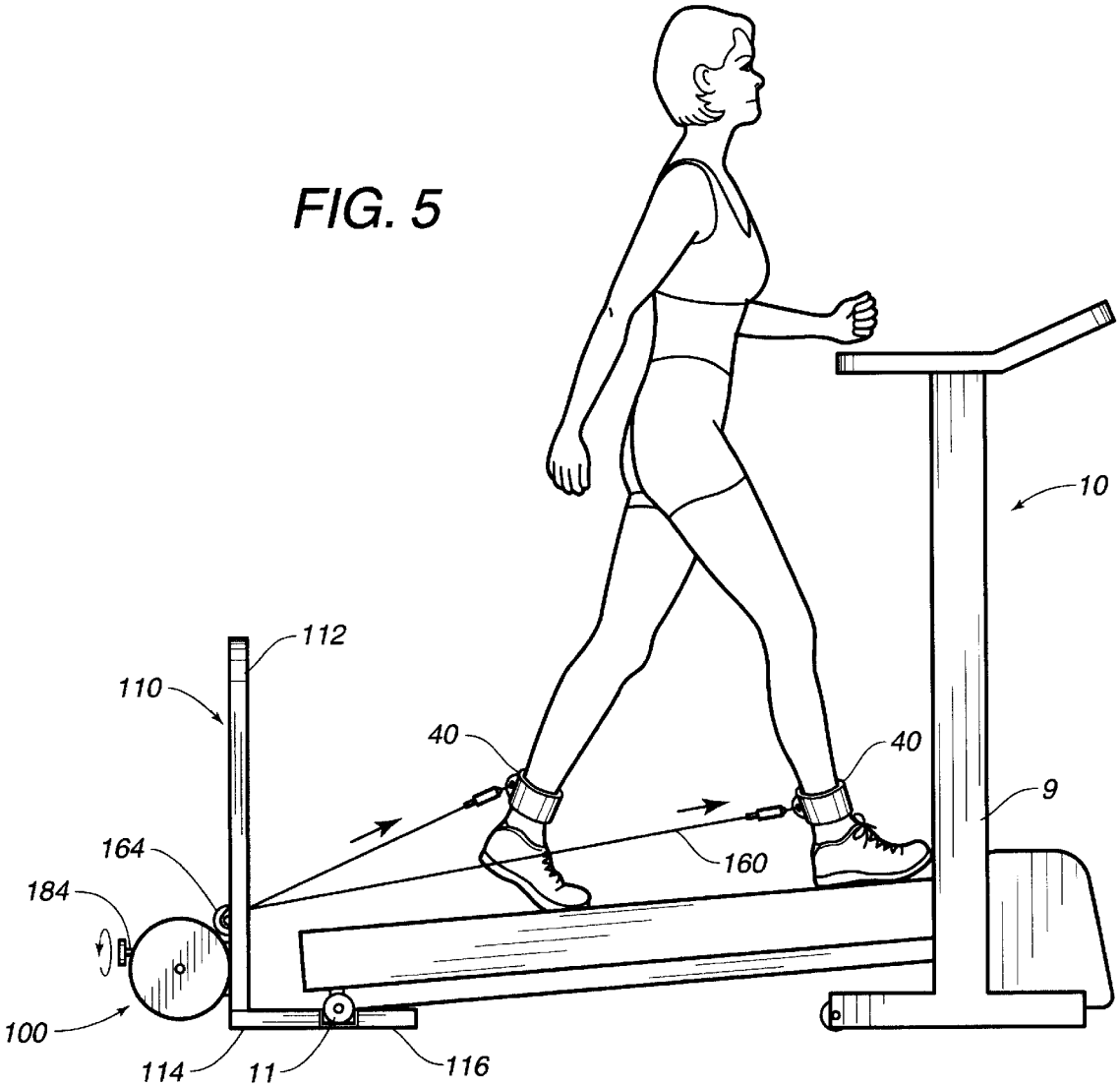
FIG. 5 is a side plan view of an alternative embodiment of the present invention.
Figure 6:
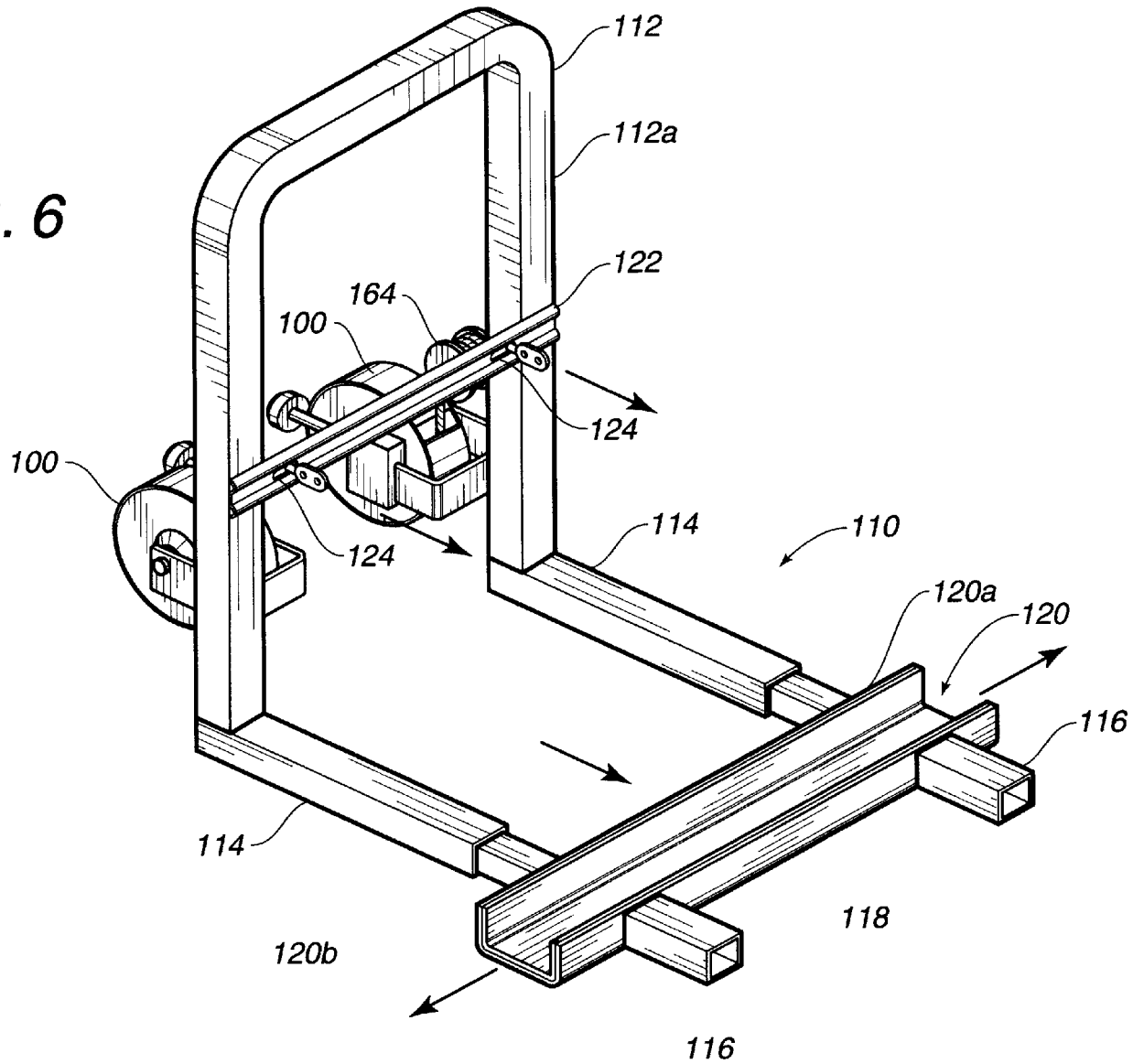
FIG. 6 is a perspective view of the support frame of the embodiment of FIG. 5.

An alternate embodiment of the invention is shown in FIGS. 5–15, in which a resistance apparatus 100 utilizes a spiral or clock spring to supply torsion/tension or resistance to the limbs or trunk. In this embodiment, the resistance apparatus 100 is attached to a tubular frame 110 that includes an inverted generally U-shaped portion 112 that is attached to a pair of longitudinally extending leg members 114 (FIG. 6). The frame is preferably made of metal. The leg members 114 have an outer end portion 116 that allows for longitudinal adjustment of the leg members 114.

The end portion 116 includes a generally rectangular shaped outer channel 118 that is positioned perpendicular to and intersecting the legs of the end portion 116. An inner channel 120, formed of two sections 120*a* and 120*b*, is positioned within the outer channel 118. The two sections 120*a* and 120*b* of the inner channel 120 allow channel 120 to be adjusted outwardly along the length of the outer channel 118 in order to accommodate the varying widths of different kinds of treadmills. After the inner channels 120*a* and 120*b* are adjusted to an appropriate width for a specific treadmill, they are secured to the outer channel 118 by nuts and bolts (not shown) or any other appropriate fastening means. The channels 118 and 120 are sized and shaped to accommodate a back end portion 11 of the treadmill 10 in which the back end portion 11 is securely placed within the inner channel 120 when the resistance apparatus 100 is used in conjunction with the treadmill 10. Alternatively, the inner channel 120 can include a skid-resistance surface on its under side so that it can be turned over and the end 11 of the treadmill 10 can be place on top of the inner channel 120.

Figure 16:
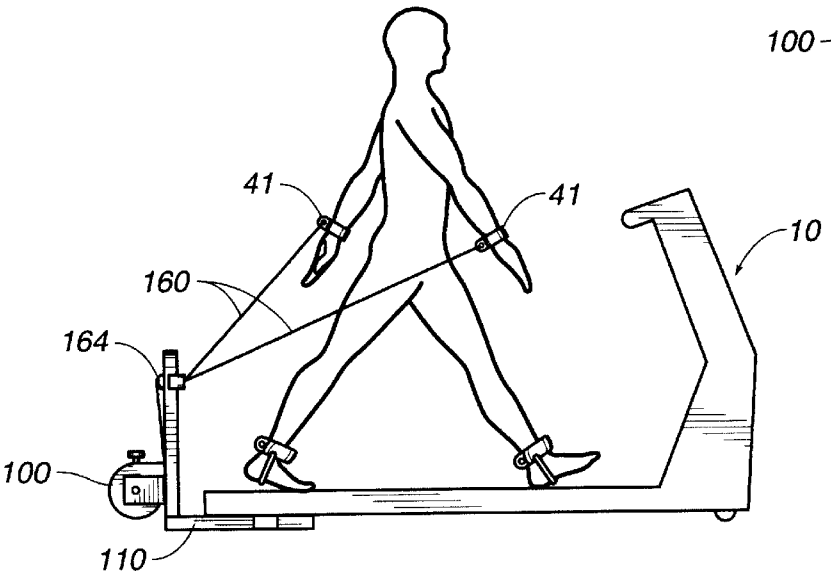
FIG. 16 is a side plan view of an alternate configuration of the invention of FIG. 5.

The U-shaped portion 112 of the frame 110 has a front portion 112*a* and a back portion 112*b* with a cross bar 122 attached to the front portion 112*a* at approximately the mid-point of the U-shaped portion 112 (FIG. 6). The cross bar 122 can be bolted to the U-shaped portion 112 or attached by any other securing means. The cross bar 122 includes two spaced apart, generally oblong openings 124 sized and shaped to thread a cable through the opening 124. Alternatively, as shown in FIGS. 16 and 17, the cross bar 122 can be adjustably positioned at other points on the U-shaped portion 112 or two cross bars 122 can be attached to the U-shaped portion 112.

Figure 7:
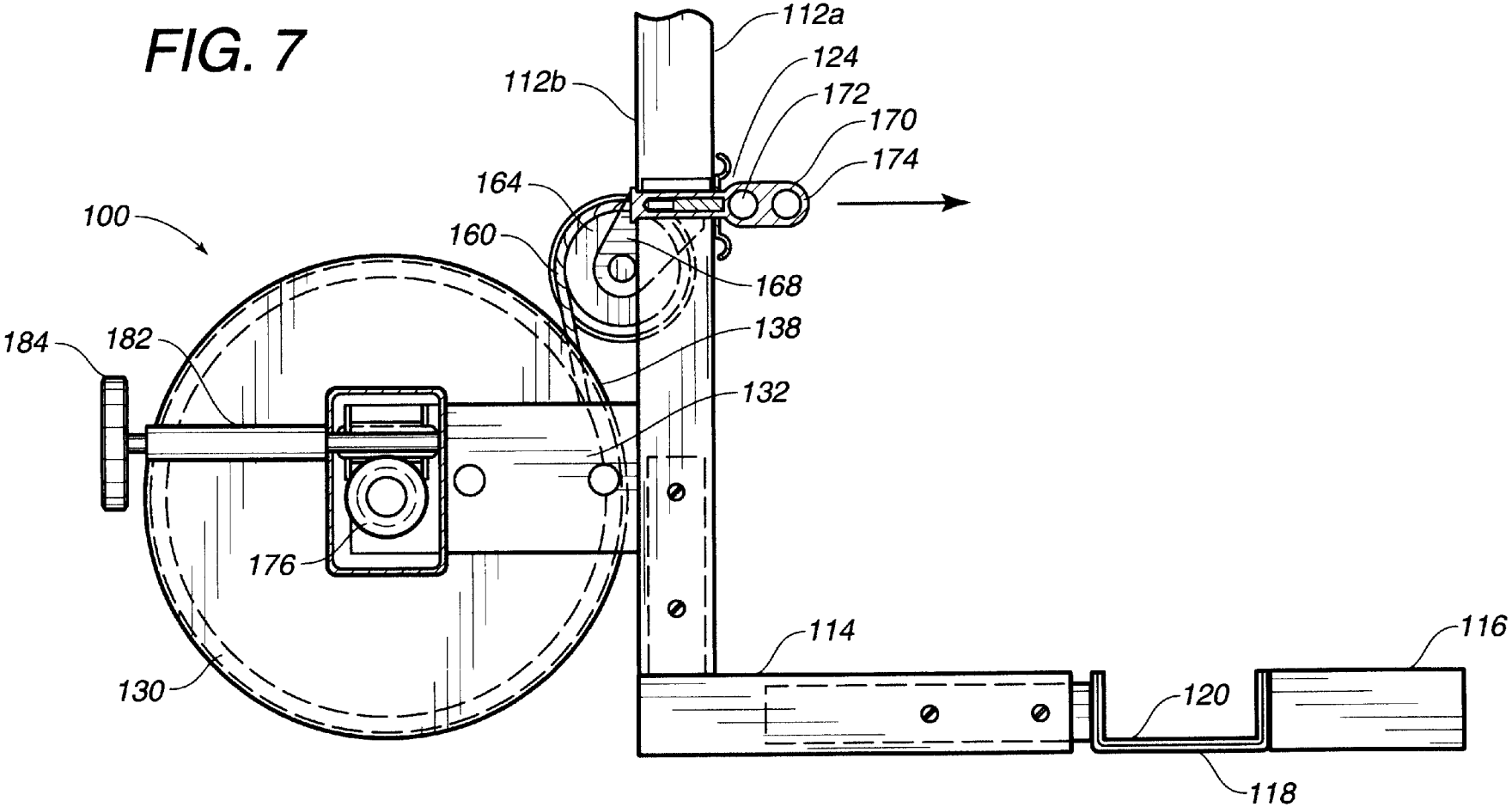
FIG. 7 is a partial cross sectional side plan view of a portion of the frame of FIG. 6.
Figure 12:
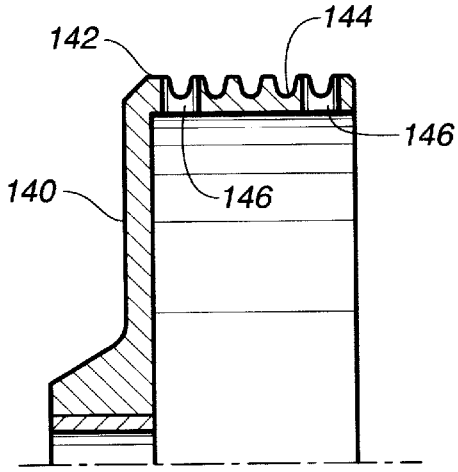
FIG. 12 is a partial cross sectional view of the apparatus of FIG. 8.
Figure 11:
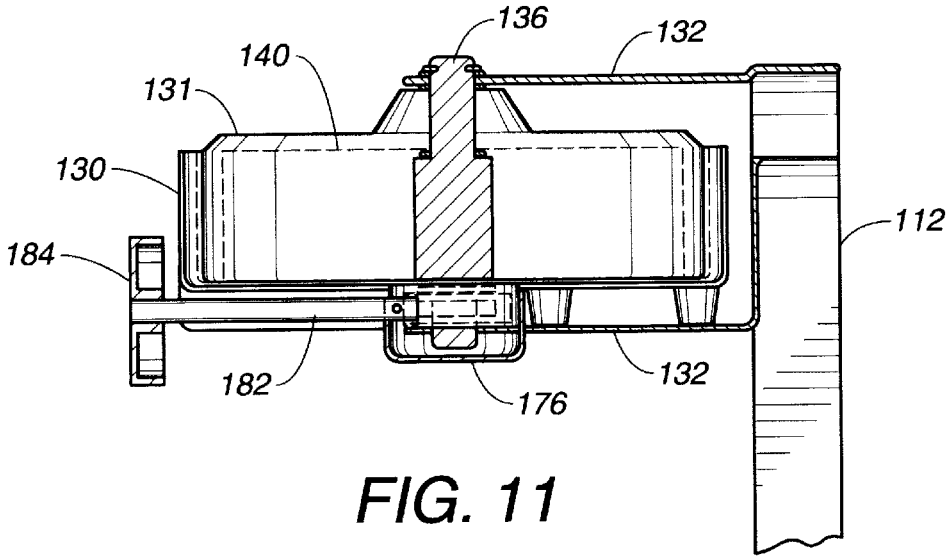
FIG. 11 is a top partial cross sectional view of the apparatus of FIG. 8.

As shown in FIG. 6 and 7, two resistance apparatus 100 are attached to the back portion 112*b* of the U-shaped portion 112. Since both of the resistance apparatus 100 are identical, only one resistance apparatus 100 will be described. The resistance apparatus is best illustrated in FIGS. 7–14. Resistance apparatus 100 includes a housing 130, a cable reel 140 and a spiral or clock spring 150. The housing 130 is generally in the shape of a cylindrical drum having walls and a chamber, with a central or shaft opening 134 through which a rotatable shaft 136 is placed. The housing 130 also includes an open portion 138 that can take the form of a slot or some other form of opening. The housing 130 is attached to a U-shaped bracket 132 through the attachment of each end of the bracket 132 to each end of the shaft 136. The U-shaped bracket 132 attaches to the back portion 112*b* of the frame 110 with bolts or other securing means (FIG. 11). The cable reel 140 (FIGS. 9 and 11), also cylindrical in shape, is positioned within the housing chamber 130. The outer surface or peripheral portion 142 of the reel 140 includes helical grooves 144 (FIG. 12) that are sized and shaped to accommodate a cable 160. The grooves 144 allow the cable 160 to be wound and guided around the outer surface 142 of the cable reel 140. The reel 140 also includes two slots 146, as shown in FIG. 12, that are sized and shaped to accommodate a portion of the spring 150.

Figure 13:
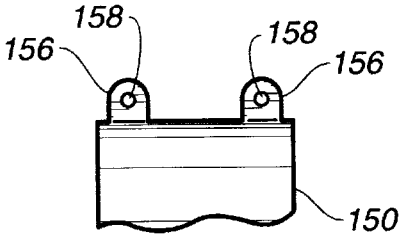
FIG. 13 is a partial front plan view of a detail of the apparatus of FIG. 9.
Figure 14:
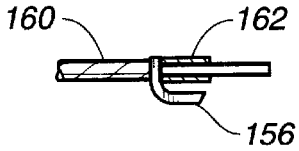
FIG. 14 is a partial side plan view of a detail of the apparatus of FIG. 9.

The spring 150 is formed of a spiral or clock spring and has a first end 152 and a second end 154. The first end 152 is fastened to the shaft 136 and the spring 150 is spirally wound around the shaft 136. The ends 152, 154 of the spring 150 can each include two tabs 156 oppositely placed on each side of the spring 150, as shown in FIG. 13. Each tab 156 includes an opening 158 that is sized to accommodate the cable 160 and to attach the spring 150 to the shaft 136. The spiral spring 150 is wound around the shaft 136 and placed within the cable reel 140. The spring tabs 156 are placed through the slots 146 of the reel 140 that allow the tabs 156 to extend slightly below the surface 142 of the reel 140. A first end of the cable 160 is then threaded through the opening 158 of one of the tabs 156 and secured in place with a cable lock 162 or other securing means (FIG. 14). A portion of the cable 160 is wound into the grooves 144 of the cable reel 140 and then around the reel 140.

Figure 8:
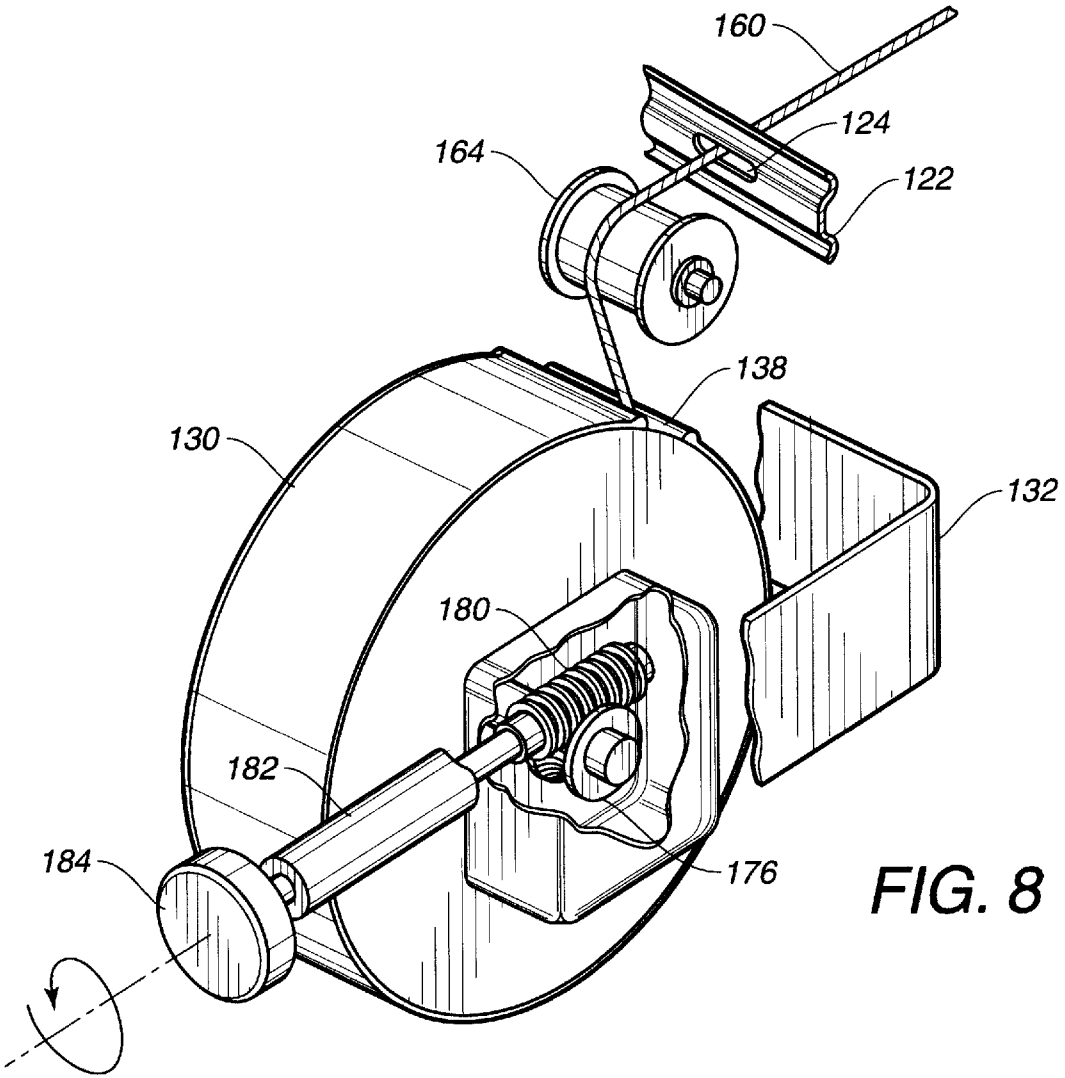
FIG. 8 is a perspective view of the resistance apparatus of the embodiment of FIG. 5.
Figure 15:
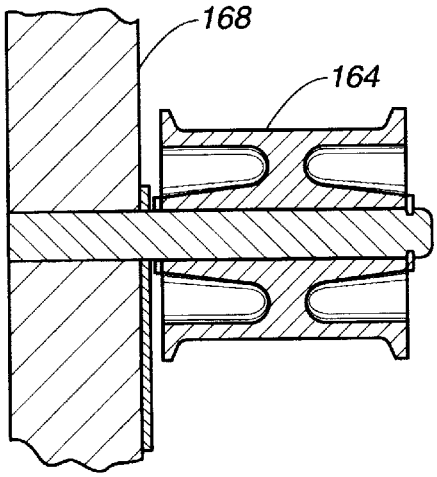
FIG. 15 is a side cross sectional view of a portion of embodiment of FIG. 5.

The assembled spring 150 and cable reel 140 are placed within the housing 130 with the shaft 136 being placed through the opening 134 in the housing 130. After the assembled spring 150 and cable reel 140 are placed within the housing 130, a cover 131 can be placed on the housing 130 in order to completely encase the spring 150 and reel 140 within the housing 130. A second end of the cable 160 is threaded through the opening 138 of the housing 130 and up and over an idler spool 164 that is rotatably attached to the back portion 112*b* of the frame 110 (FIGS. 7 and 8). The idler spool 164 can be attached to the frame 110 by means of a strut 168 or some other suitable fastening means (FIG. 7). The cable 160 is then threaded through the opening 124 in the cross bar 122. After threading the cable 160 through the opening 124, the second end of the cable 160 is attached to one opening 172 of a connector 170 having two parallel openings 172, 174. The second opening 174 is used to connect the cable 160 to the ankle or arm cuffs 40, 41.

As shown in FIG. 8, one end of the shaft 136 preferably includes a worm gear 176 integral with the shaft, which engages a worm 180 attached to one end of a tension control rod 182. A knob 184 is placed on the other end of the control rod 182. The control rod 182 is used to regulate the torsion/tension of the spiral spring 150 by either increasing or decreasing the torsion/tension on the spring 150 around the shaft 136, and thus controlling the torsion/tension or the resistance on the cable 160. Alternatively, other mechanisms can be used to regulate the torsion/tension on the spiral spring 150.

In order to set the torsion/tension or resistance of the resistance apparatus 100, the cable 160 is first preset by pulling the second end of the cable 160 out from the cross bar 122 a predetermined distance appropriate for a particular user's stride requirements. A stop (not shown) is attached to the cable 160 on the front portion 112*a* of the frame 110 in order to prevent the cable 160 from pulling through the opening 124 in the cross bar 122. The knob 184 is then turned clockwise or counter clockwise in order to wind the spiral spring 150 tighter to produce more torsion/tension, or to unwind the spiral spring 150 to produce less torsion/tension on the cable 160. The torsion/tension then transferred to the limbs of a user as resistance. The resistance apparatus 100 can also be turned 180° in order to pull the cable 160 in an opposite direction.

As shown in FIGS. 16 and 17, the resistance apparatus 100 can be attached to either the legs or the arms of a user or to both the legs and arms simultaneously. To do this the idler spool 164 is moved to the upper portion of the frame 110 so that the cable 160 can be attached to the arms. Alternatively, a second pair of resistance apparatus 100 can be attached to the upper portion of the frame 110 so that both the arms and legs may be exercised simultaneously. The cuffs 40, 41 can be attached to any part of the arm or leg and the cuffs 40, 41 can be moved along the limb as the user is using the resistance apparatus 100. Additionally, an elastomeric cord of various strengths can be attached between the cable 160 and the cuffs 40, 41 in order to reduce the amount of tension placed on the limbs and provide additional potential benefits to the user.

An inventive feature of the resistance apparatus 100 is the configuration of the spiral spring 150. The spring 150 is configured to provide a predetermined pattern of resistance force to the cable 160. This force is than transferred to the user's limbs or any desired muscle group, in response to the normal movement of the limbs, when the user is walking or running on the treadmill or when the user is engaging in other forms of exercise. By altering the width, thickness and length of the spring during the manufacturing process, the resistance force of the spring 150 can be controlled. Changing any of the dimensional characteristics of the spring 150 will alter this force, however, it is easiest to alter the width and/or length of the spring 150 while maintaining a constant thickness. By selectively changing the width of the spring 150 at certain distances between its first and second ends 152, 154, it is possible to obtain either a constant or variable resistance force as desired. This ability allows the tension of the resistance apparatus 100 to be applied in a preselected manner determined by the user. A further advantage of using the spiral spring 150 in the resistance apparatus 100 is that the immediate recoil of a spiral spring, it works with the speed of the body so that both the body and the spring are working in unison. Because both the body and the spring are in unison, there is constant resistance on the muscles of the body, producing the most effective kind of exercise. Since the preferred method of exercising is to maintain constant resistance on the body at all times, the resistance apparatus 100 of the present invention provides this constant tension.

Referring to FIG. 18, a simplified form of the present invention is particularly illustrated. As can be seen in FIG. 18, the treadmill 10 has the frame 200 integrally connected thereto. The frame 200 can be part of the frame of the treadmill 10 or can be placed and affixed directly beneath the bottom surface of the treadmill 10. As can be seen, a person 202 is walking on the treadmill belts 204 in a forward direction (as illustrated by the arrow in FIG. 18). The frame 200 includes a horizontal portion 206 and a vertical portion 208. The resistance means 210 is connected to the vertical portion 208 of the frame 200.

In particular, in FIG. 18, it can be seen that the resistance means 210 includes a first elastomeric cord 212 which has one end connected to a cuff 214 around the leg 216 of the person 202. This elastomeric cord 202 is fastened, by conventional means, to the vertical section 208 of the frame 200. A second elastomeric cord 216 is connected to a cuff 218 around a leg 220 of the person 202. The opposite end of the elastomeric cord 216 is fastened to the vertical section 208 of the frame 200. The elastomeric cords 202 and 216 will exert a resistance force onto the legs 216 and 220 of the person 202 as the person 202 is moving in a forward direction. Since the resistance force is coming from the rear of the treadmill 10 by virtue of the vertical section 208 being positioned behind the rear of the treadmill 10, proper resistance force is applied to the legs 216 and 220 of the person 202. A similar arrangement, such as shown in FIG. 18, can be applied to the arms 222 and 224 of the person 202.

FIG. 19 shows another simplified embodiment 300 of the resistance apparatus of the present invention. As can be seen in FIG. 19, the treadmill 10 is connected to a frame 302. A vertical section 304 of frame 302 extends upwardly from behind the rearward end 306 of the treadmill 10. In FIG. 19, it can be seen that the resistance means 308 includes a first elastomeric cord 310 and a second elastomeric cord 312. Each of the elastomeric cords 310 and 312 is connected to a belt 314 extending around the trunk of the person 316. The elastomeric cord 310 and 312 are fastened, by conventional means, to the vertical section 304 of the frame 302.

Importantly, in the embodiment 300 of the present invention, the resistance means 308 can include a single elastomeric cord 310.

The embodiment shown in FIG. 19 will provide exercise similar to parachute training techniques. The use of the elastomeric cords 310 and 312 as part of the "resistance means 308" will provide similar parachute-type forces to the person 316 as the person 316 is moving in a forward motion along the belt of the treadmill 10. As such, this form of resistance means greatly improves speed training for the person 316 without the large space requirements associated with parachute training techniques. Furthermore, the use of the cords 310 and 312 will eliminate the possibility of tripping or falling caused by the inadvertent tangling of the cords associated in parachute training devices.

Figure 20:
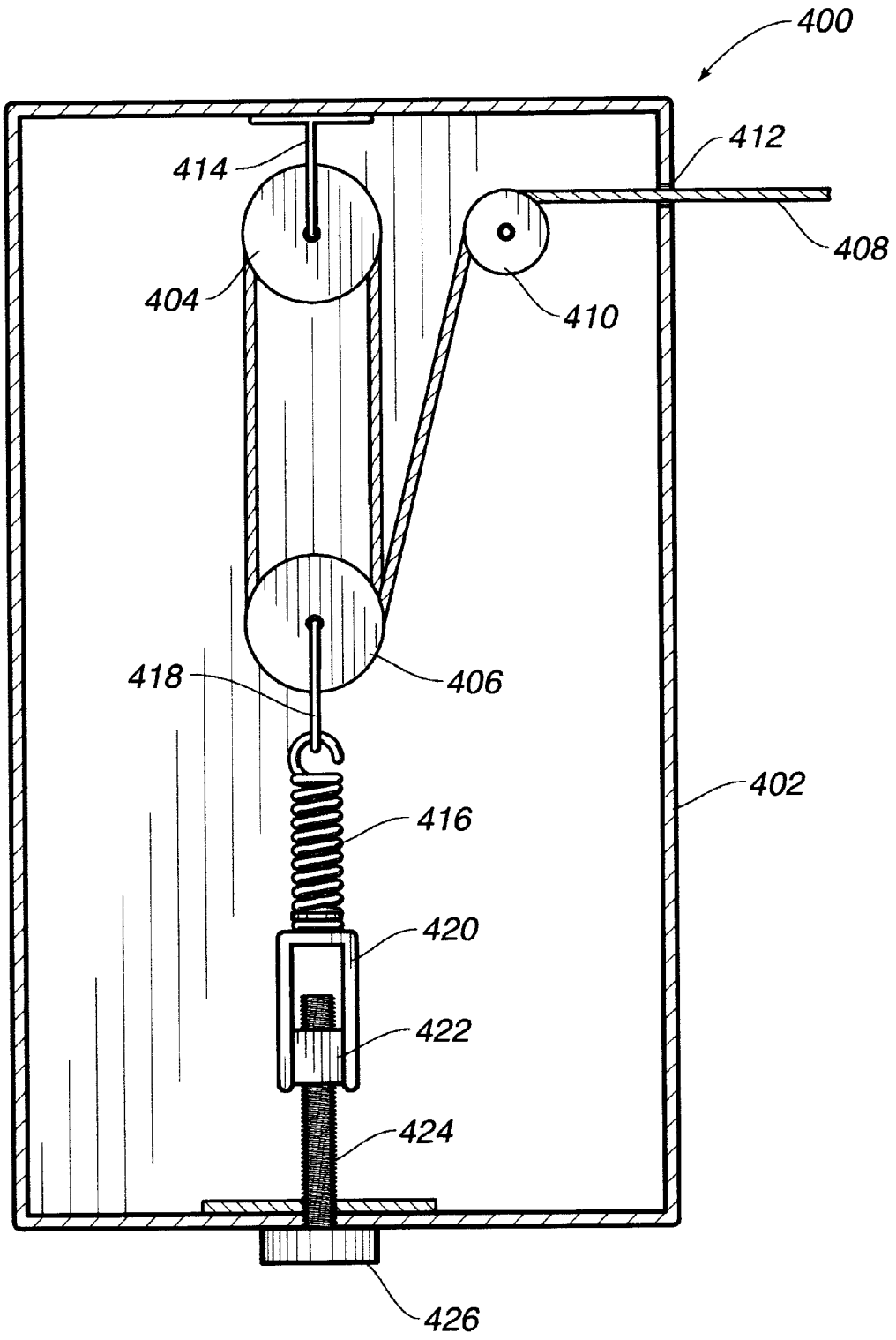
FIG. 20 is a side view with a housing/pulley mechanism as the resistance means.

The resistance means, as shown in FIG. 20, is the preferred embodiment of the present invention. In FIG. 20, the resistance means 400 is made up of a housing 402 with a first pulley 404 fixedly connected to the housing 402, a second pulley 406 resiliently connected to the housing 402 and a cable 408 extending around the first pulley 404 and the second pulley 406 and having an end extending outwardly of the housing. As can be seen in FIG. 20, the housing is a box which can be suitably connected to the frame associated with the treadmill apparatus. The cable 408 will extend around an idler sheave 410 and passes outwardly through opening 412 of housing 402. The first pulley 404 is suspended from the top of the housing 402 by a supporting member 414. The pulley 404 can freely rotate within the supporting member 414. The cable 408 will extend over the idler sheave 410, around the second pulley 406, around the first pulley 404 and back for fixed attachment to the second pulley 406.

The second pulley 406 is resiliently mounted within the housing 402 by attachment to a tensioning spring 416. Tensioning spring 416 has one end connected to an arm 418 which engages the second pulley 406. The pulley 406 is rotatable relative to the arm 418. The opposite end of the spring 416 is connected to a bracket 420 associated with a nut 422. Nut 422 has an adjustment screw 424 threadedly received therein. The adjustment screw 424 is rotatably mounted through a wall of the housing 402 such that a head 426 extends outwardly of a surface of the housing 402. A rotation of the head 426 will cause the nut 422 to adjust the tensioning of the spring 416 by translatable movement along the threaded adjustment screw 424. For example, as the bracket 420 is moved toward the head 426 by the rotation of the adjustment screw 424, the spring 416 will exert greater tension on the pulley 406. When the bracket 420 moves away from the head 426, the spring 416 will compress so as to relax the tension on the pulley 406.

The resistance mechanism 400, as illustrated in FIG. 20, has several advantages over the tensioning mechanism described herein previously in conjunction with FIGS. 1–17. Initially, and most importantly, the resistance mechanism 400 can be made without specialized tooling. With a predetermined number of cable/pulley arrangements, the cable travel can be obtained with a small displacement of the spring. A small displacement of the spring will minimize the space requirements and size of the spring 416. The tensioning can be easily accomplished by the use of the adjustment screw 424.

Figure 22:
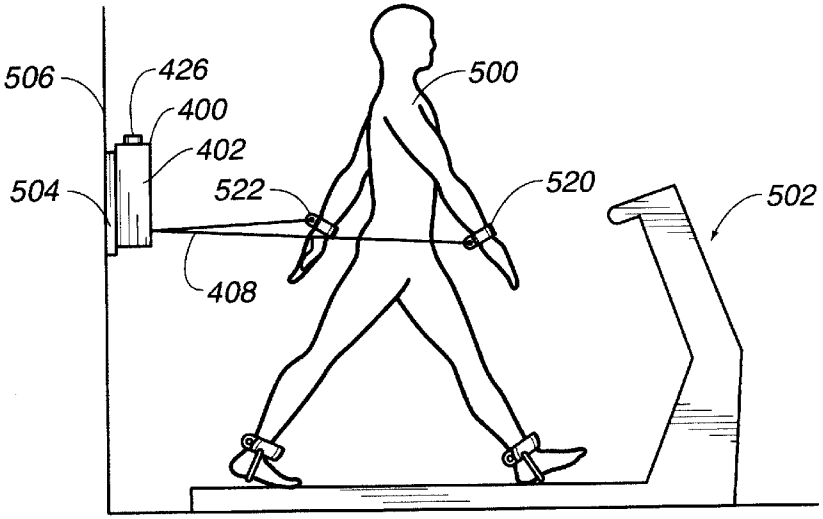
FIG. 22 shows the spring/pulley mechanism of FIG. 20 as applied to a treadmill for the exercise of the arms of a human body.
Figure 21:
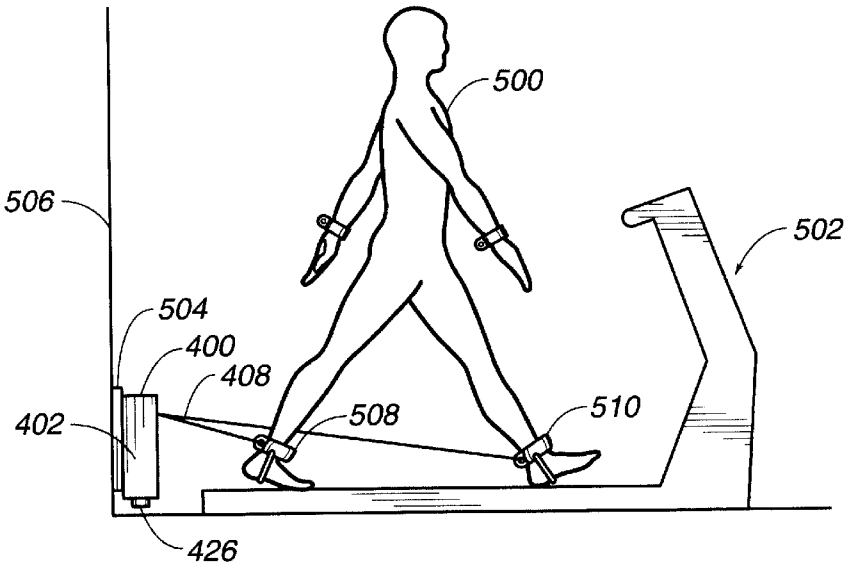
FIG. 21 is a side view of the spring/pulley mechanism of FIG. 20 as applied for exercising the legs of the human body.

FIGS. 21 and 22 show how the resistance mechanism 400 can be used in conjunction with the exercise apparatus described herein previously. In FIG. 21, it can be seen that the human body 400 is walking in a conventional forward motion on the treadmill 402. The resistance mechanism 400 is secured to an adjustment bracket 504 which is adjustably mounted on vertical frame member 506. The head 426 of the adjustment screw 424 extends outwardly beyond the bottom of the resistance mechanism 400. The cable 408 extends outwardly of the housing 402 and includes cuff members 508 and 510 attached to the ankles of the human being 500. As such, the resistance mechanism 400 is in a proper position for the exercising of the legs of the person 500.

FIG. 22 shows the resistance mechanism 400 in an inverted arrangement. In this inverted arrangement, the head 426 of the adjustment screw extends outwardly of the top of the housing 402. The resistance mechanism 402 is affixed to support member 504 attached to the vertical frame portion 506. The cable 408 extends outwardly from a bottom of the housing 402 so as to be in a proper position for attachment to wrist cuffs 520 and 522 attached to the human 500. As such, a proper arm exercise can be carried out by using the resistance apparatus 400 in accordance with the preferred embodiment of the present invention.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

We claim:

1. A resistance apparatus for use in fitness exercising and rehabilitation comprising:

a treadmill having a rearward end, said treadmill having a first side rail and a second side rail at said rearward end;

a frame connected to said treadmill and positioned behind said rearward end of said treadmill, said frame comprising:

a horizontal section having a first side releasably connected to said first side rail of said treadmill, said horizontal section having a second side releasably connected to said second side rail of said treadmill; and a vertical section extending upwardly from said horizontal section and spaced by a distance rearwardly of said rearward end of said treadmill; and a resistance means affixed to said vertical section of said frame and having an end connectable to a human body, said resistance means for exerting a resistance force onto the human body from a back of the human body as the human body carries out a forward motion on the treadmill.

2. The apparatus of claim 1, said resistance means being adjustably connected along a length of said vertical section.

3. The apparatus of claim 1, said resistance means comprising:

a cord extending from said frame, said cord having a cuff member at said end, said cuff member adapted to be attached around a leg or an arm of the human body.

4. The apparatus of claim 1, said resistance means comprising:

a cord extending from said frame, said cord having a belt member at said end, said belt member adapted to be attached around a trunk of the human body.

5. The apparatus of claim 3, said cord being an elastomeric cord.

6. The apparatus of claim 4, said cord being an elastomeric cord.

7. A resistance apparatus for use in fitness exercising and rehabilitation comprising:

a treadmill having a rearward end;

a frame connected to said treadmill and positioned behind said rearward end of said treadmill; and resistance means affixed to said frame and having an end connectable to a human body, said resistance means for exerting a resistance force onto the human body from a back of the human body as the human body carries out forward motion on said treadmill, said resistance means comprising:

a housing;

a first pulley fixedly mounted to said housing;

a second pully resiliently connected to said housing; and a cable extending around said first and second pulleys, said cable having an end extending outwardly of said housing, said end being adapted for connection to the human body.

8. The apparatus of claim 7, said resistance means further comprising:

an adjustment mechanism interconnected to said first and second pulleys, said adjustment mechanism adapted to adjust a tension of said cable as extending from said second pulley.

9. The apparatus of claim 8, said adjustment mechanism comprising:

a spring connected to said second pulley;

a nut threadedly connected to said spring; and an adjustment screw threadedly received by said nut, said adjustment screw having a head portion extending outwardly of said housing.

* * * * *

UNITED STATES PATENT AND TRADEMARK OFFICE

CERTIFICATE OF CORRECTION

PATENT NO. : 6,123,649

DATED : September 26, 2000

INVENTOR(S) : R. Clayton Lee; Michael A. Karr

It is certified that error appears in the above-identified patent and that said Letters Patent is hereby corrected as shown below:

On page 1, column 1, after the "Inventor" line, insert an "Assignee" line, as follows:

Assignee: R. Clayton Lee, Houston, Texas

Signed and Sealed this

Fifteenth Day of May, 2001

*Attest:*

Nicholas P. Godici

NICHOLAS P. GODICI

*Attesting Officer*

*Acting Director of the United States Patent and Trademark Office*